US007954485B2

(12) United States Patent
Cadima et al.

(10) Patent No.: US 7,954,485 B2
(45) Date of Patent: Jun. 7, 2011

(54) METHOD AND APPARATUS FOR VENTILATING COOKING APPLIANCES

(75) Inventors: Paul B. Cadima, Prospect, KY (US); Brian S. Henninger, LanGrange, KY (US)

(73) Assignee: General Electric Company, Schenectady, NY (US)

( * ) Notice: Subject to any disclaimer, the term of this patent is extended or adjusted under 35 U.S.C. 154(b) by 1255 days.

(21) Appl. No.: 11/241,637

(22) Filed: Sep. 30, 2005

(65) Prior Publication Data

US 2007/0074713 A1 Apr. 5, 2007

(51) Int. Cl.
*A21B 1/00* (2006.01)
*A21B 3/00* (2006.01)

(52) U.S. Cl. ..... 126/21 R; 126/21 A; 126/10 R; 126/273 A; 126/273 R; 219/400; 99/331

(58) Field of Classification Search ..... 126/21 R, 126/21 A, 299 B, 273 R, 273 A; 219/400; 99/331

See application file for complete search history.

(56) References Cited

U.S. PATENT DOCUMENTS

| | | | | |
|---|---|---|---|---|
| 3,889,100 | A * | 6/1975 | Dills | 219/393 |
| 4,241,718 | A * | 12/1980 | Barnett | 126/21 R |
| 4,474,107 | A * | 10/1984 | Cothran | 99/352 |
| 4,763,638 | A * | 8/1988 | Hurley et al. | 126/21 A |
| 6,172,338 | B1 * | 1/2001 | Barnes et al. | 219/399 |
| 6,191,391 | B1 * | 2/2001 | Deo et al. | 219/407 |
| 6,761,159 | B1 * | 7/2004 | Barnes et al. | 126/21 R |

* cited by examiner

*Primary Examiner* — Steven B McAllister
*Assistant Examiner* — Nikhil Mashruwala
(74) *Attorney, Agent, or Firm* — Armstrong Teasdale LLP

(57) ABSTRACT

A cooling apparatus is provided for cooling a cabinet of a cooking appliance that includes an oven within exterior side panels. The cooling apparatus includes a side rail and a bottom panel coupled to the side rail. The bottom panel includes a slot therein. A cover is disposed over the bottom panel to form a channel. The slot opens into the channel. The cover is configured to direct cooling air from the slot into a space between the oven and the side panels.

17 Claims, 6 Drawing Sheets

METHOD AND APPARATUS FOR VENTILATING COOKING APPLIANCES

BACKGROUND OF THE INVENTION

This invention relates generally to free standing cooking appliances, and, more specifically, to methods and apparatus for cooling the cabinets of free standing ranges.

In general, cooking appliances, such as free standing ranges are provided with a cooling system so that external cabinet temperatures remain safe to touch and do not damage control components or other surroundings. In more modern ranges, natural convective airflow through the range is used to manage exterior cabinet temperatures. Traditionally, convective cooling air enters the bottom of the range and, by natural convection, flows upwardly through the cabinet. In ranges that include a lower storage drawer, the drawer compartment provides a source for cooling air. That is, the natural rising of heated air draws in cooler air from around the drawer which the flows through the cabinet to cool the cabinet.

At least some ranges are dual oven designs wherein the storage drawer is eliminated in favor of a second oven. In such ranges, the lower compartment becomes part of the oven space and is closed or sealed. This eliminates the airflow source and paths that have traditionally been available for cooling. Various approaches have been taken to address dual oven cooling. For instance, additional insulation may be provided around the oven cavities; however, this adds to the cost of the product. Alternatively, the ovens could be reduced in size to provide larger clearances for heat management, or lower powered ovens and cooktops could be employed to reduce heat management needs. Such solutions, however, are also undesirable. Thus, cooling in free standing ranges and, particularly those with dual oven designs, remains a challenge.

BRIEF DESCRIPTION OF THE INVENTION

In one aspect, a cooling apparatus is provided for cooling a cabinet of a cooking appliance that includes an oven within exterior side panels. The cooling apparatus includes a side rail and a bottom panel coupled to the side rail. The bottom panel includes a slot therein. A cover is disposed over the bottom panel to form a channel. The slot opens into the channel. The cover is configured to direct cooling air from the slot into a space between the oven and the side panels.

In another aspect, a cooking appliance is provided that includes a cabinet including opposed side panels, a bottom panel, positioned between the side panels, and a side rail coupled to each side panel. The cabinet is configured to be supported on a supporting surface such that an air gap is formed between the bottom panel and the supporting surface. The bottom panel includes a slot for admitting cooling air. At least one oven is positioned within the cabinet and defines a space between the oven and the side panels. A cover is disposed over the bottom panel to form a channel. The slot opens into the channel, and the cover is configured to direct cooling air from the slot into a space between the oven and the side panels.

In yet another aspect, a method of convective cooling is provided for a cooking appliance having a cabinet including a bottom panel, a side rail coupled to each side panel, and at least one oven positioned between the side panels and above the bottom panel. The method includes forming a slot in the bottom panel, providing an opening in the side rails, positioning a cover over the bottom panel slot and the side rail opening to form a channel, causing cooling air to flow from the bottom panel slot into the channel, and directing the cooling air through the side rail opening, and into a space between the oven and the side walls.

DETAILED DESCRIPTION OF THE INVENTION

Figure 1:
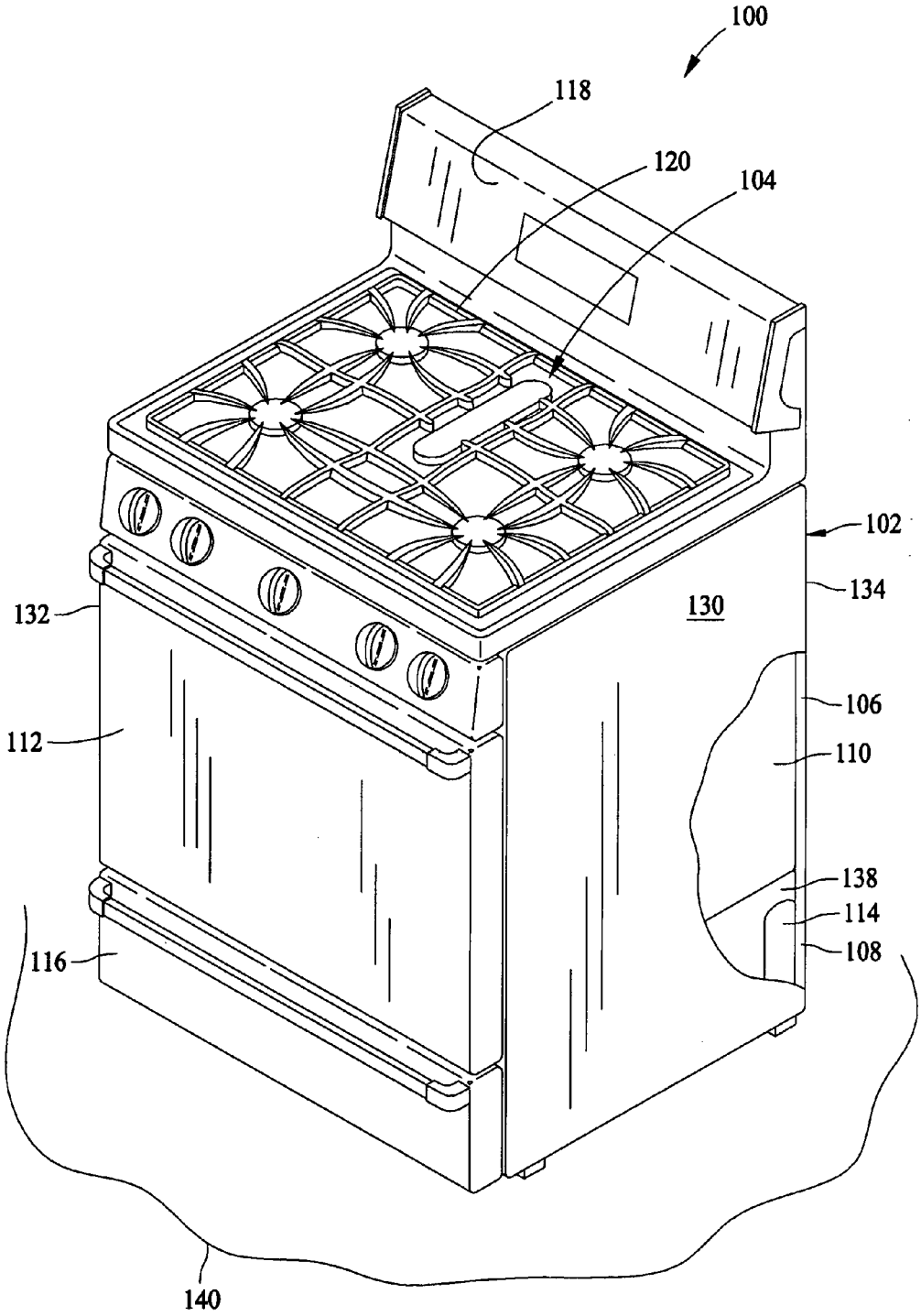
FIG. 1 is a perspective view of an exemplary free standing cooking appliance.

FIG. 1 illustrates a cooking appliance in the form of a free standing gas range 100 including an outer body or cabinet 102 that incorporates a generally rectangular cooktop 104. Cabinet 102 includes an upper cavity 106 and a lower cavity 108. An upper oven 110 is positioned below cooktop 104 in upper cavity 106 and has a front-opening access door 112. A lower oven 114 is positioned in lower cavity 108. Lower oven 114 has a front-opening access door 116. A range backsplash 118 extends upward of rear edge 120 of cooktop 104 and contains various control selectors (not shown) for selecting operative features of heating elements for cooktop 104 and the upper and lower ovens 110 and 114, respectfully.

While the invention will be described in terms of a free standing gas range, it is contemplated that the benefits of the present invention are equally applicable electric ranges, gas and electric built-in units, and combination gas and electric cooking appliances. Therefore, gas range 100 is provided by way of illustration only and no limitation is intended thereby.

Figure 2:
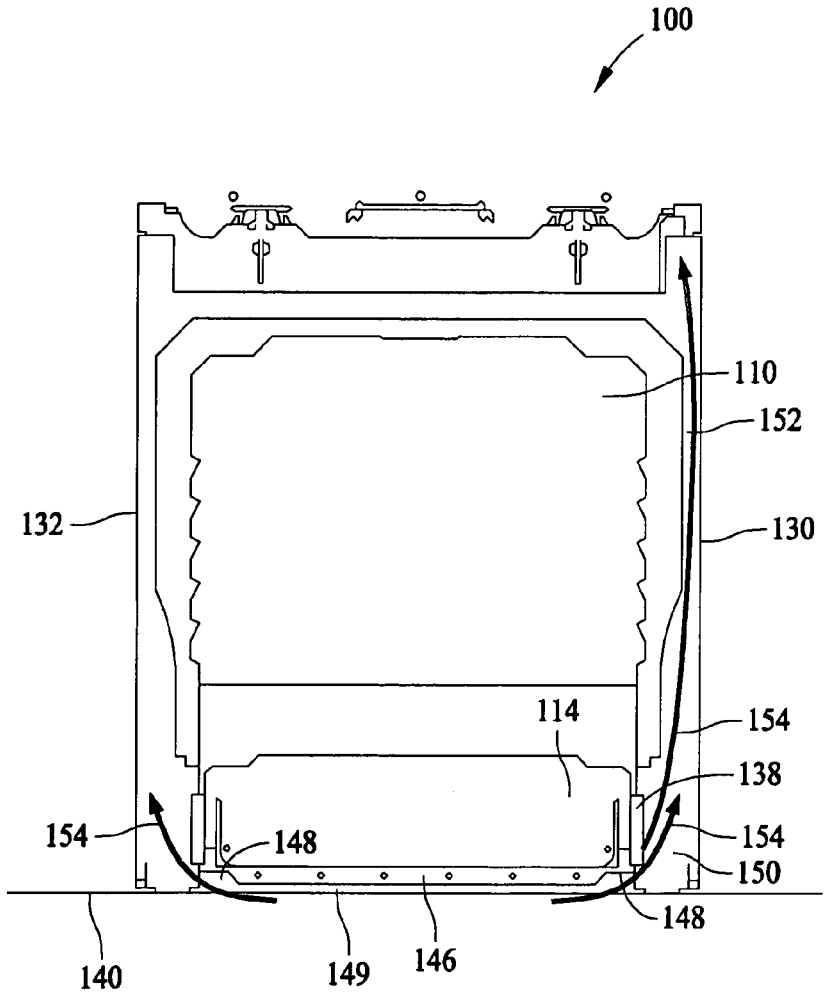
FIG. 2 is a front schematic view of a cooking appliance.

Cabinet 102 includes opposed side panels 130 and 132, a back panel 134, and a bottom panel 146 (see FIG. 2). Back panel 134 and bottom panel 146 are positioned between side panels 130 and 132. Side rails 138 are provided on each side of cabinet 102 and are coupled to side panels 130 and 132. Side rails 138 are part of a chassis (not shown) that supports appliance 100. The chassis, including side rails 138, supports appliance on a supporting surface 140 in such a manner that an air gap 149 (FIG. 2) exists between bottom panel 146 and supporting surface 140.

FIG. 2 illustrates a front schematic view of cooking appliance 100. As illustrated in FIG. 2, ovens 110 and 114 are positioned between side panels 130 and 132 and above bottom panel 146. Bottom panel 146 includes slots 148 therethrough that admit cooling air from air gap 149 between bottom panel 146 and supporting surface 140. Cooling air is drawn into slots 148 by natural convection. Cooling air is directed into a gap 150 between side rail 138 and side panels 130 and 132 to a space 152 between ovens 110 and 114 and side panels 130 and 132 and flows upwardly as indicated by arrows 154.

Figure 3:
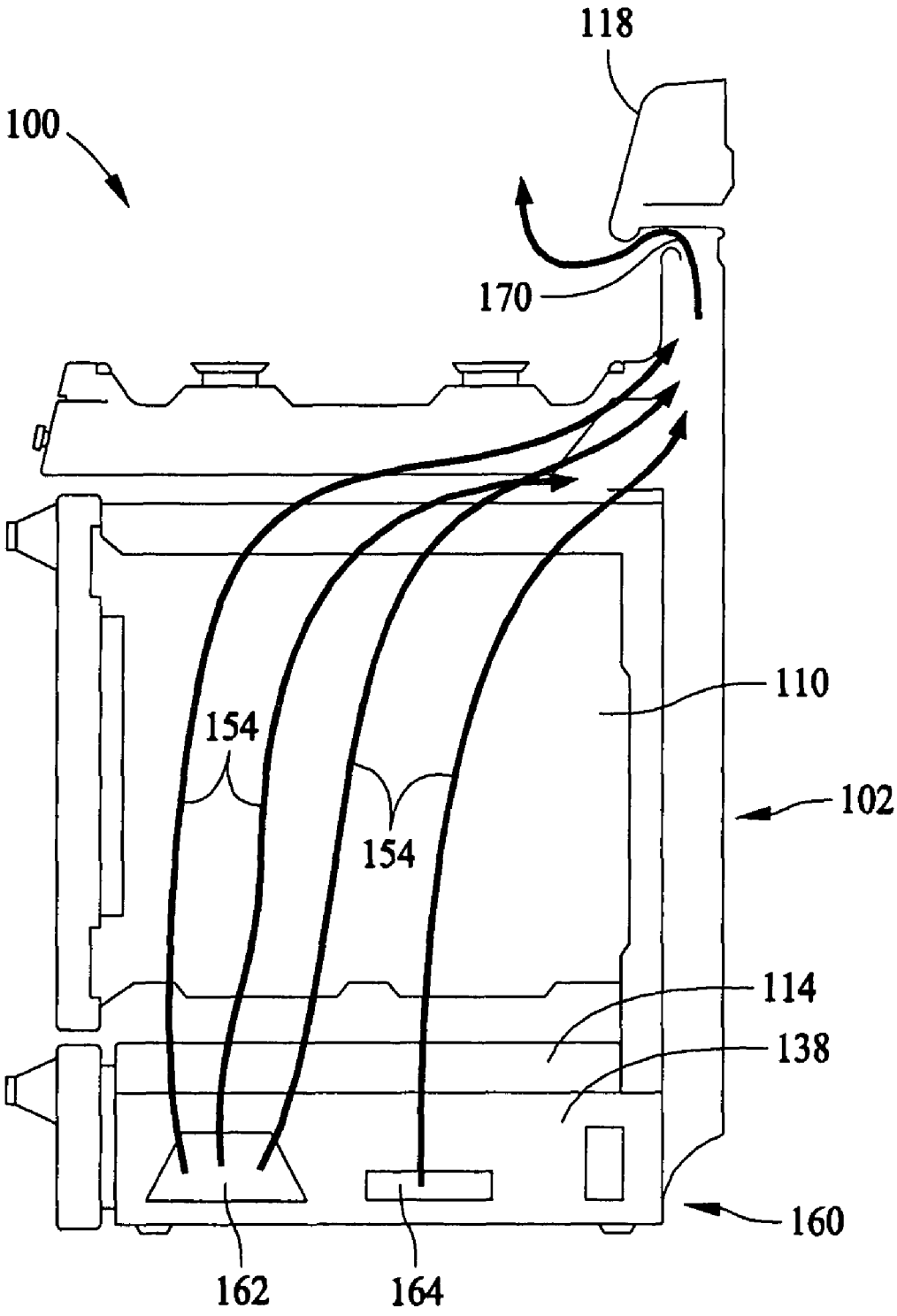
FIG. 3 is a side schematic view of the cooking appliance shown in FIG. 2.

FIG. 3 illustrates a side schematic view of cooking appliance 100. As illustrated in FIG. 3, side rails 138 are positioned proximate a bottom portion 160 of cabinet 102. Side rails 138 are provided with openings 162 and 164 that receive cooling air admitted through slots 148 (FIG. 2) in bottom panel 146. Cooling air passes through openings 162 and 164 and into space 152 between ovens 110 and 114 as indicated by arrows 154. After passing through space 152, the heated cooling air enters backsplash 118 and is exhausted through downward facing exhaust vents 170 formed in backsplash 118.

Figure 4:
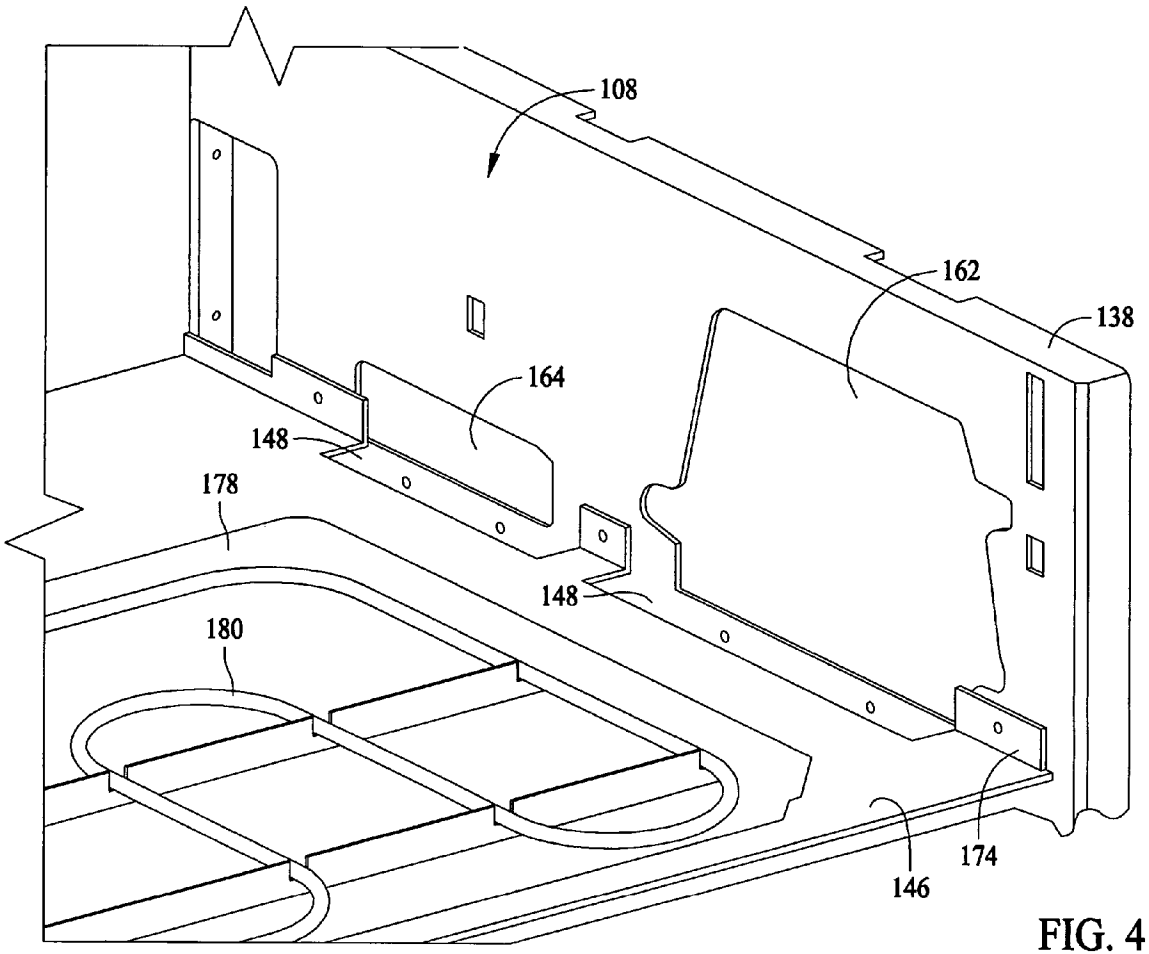
FIG. 4 is a fragmentary view of an exemplary lower cavity bottom panel and side rail for a cooking appliance.

FIG. 4 illustrates a fragmentary view of an exemplary bottom panel 146 and side rail 138 in cooking appliance 100. Bottom panel 146 includes a side edge 174. Slots 148 are formed in bottom panel 146 proximate side edge 174. In an exemplary embodiment, slots 148 comprise cutouts in side edge 174. Slots 148 are open to air gap 149 (FIG. 2) between bottom panel 146 and supporting surface 140 (FIG. 1). Cooling air is drawn into slots 148 by natural convective air flow around ovens 110 and 114.

In some embodiments, lower cavity 108 may also include a slidable warming drawer (not shown) for warming food items or keeping prepared items warm. Bottom panel 146 may be formed with a recessed area 178 that includes a heating element such as warming element 180. Warming element 180 may be used in conjunction with the warming drawer for keeping foods warm. In alternative embodiments, lower oven 114 may be replaced by a storage drawer, in which case, warming element 180 would not be present and lower cavity 108 may not be sealed. Bottom panel 146 is coupled to side rail 138. Side rail 138 includes openings 162 and 164 which are positioned proximate slots 148 in bottom panel 146. Openings 162 and 164 receive cooling air admitted through slots 148 and direct the cooling air outward toward side panels 130 and 132 (FIG. 1). Locating openings 162 and 164 in close proximity to slots 148 reduces the amount of bending in the air flow path and lowers resistance to convective air flow.

Figure 5:
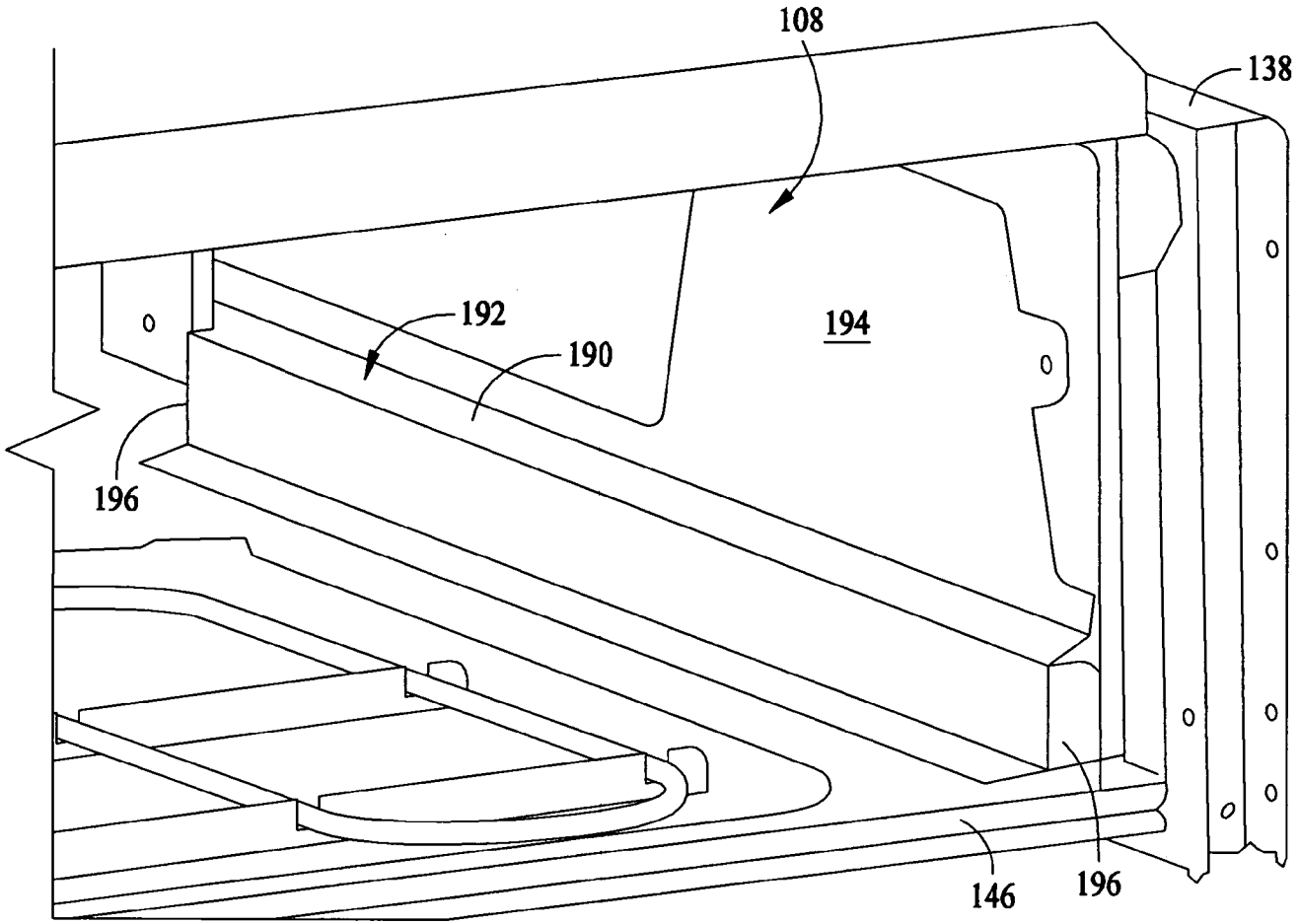
FIG. 5 is a fragmentary view of an exemplary lower cavity bottom panel and side rail with a cover forming an air inlet channel.

FIG. 5 illustrates a fragmentary view of an exemplary bottom panel 146 and side rail 138 with a cover 190. Cover 190 is positioned over slots 148 (FIG. 4) to form an air inlet channel 192. Cover 190 also covers opening 164 (FIG. 4) and is formed with a tab 194 that covers side rail opening 162 (FIG. 4) in side rail 138. In an exemplary embodiment, cover 190 is formed from sheet metal and may be shaped as necessary to cover desired side rail openings. Cover 190 may be coupled to either or both of bottom panel 146 and side rail 138. Channel 192 includes substantially closed ends 196. Channel 192, or more specifically, cover 190, directs cooling air through openings 162 and 164 and into a gap 150 (FIG. 2) between side rail 138 and side panels 130 and 132 on the outer side of side rail 138.

Figure 6:
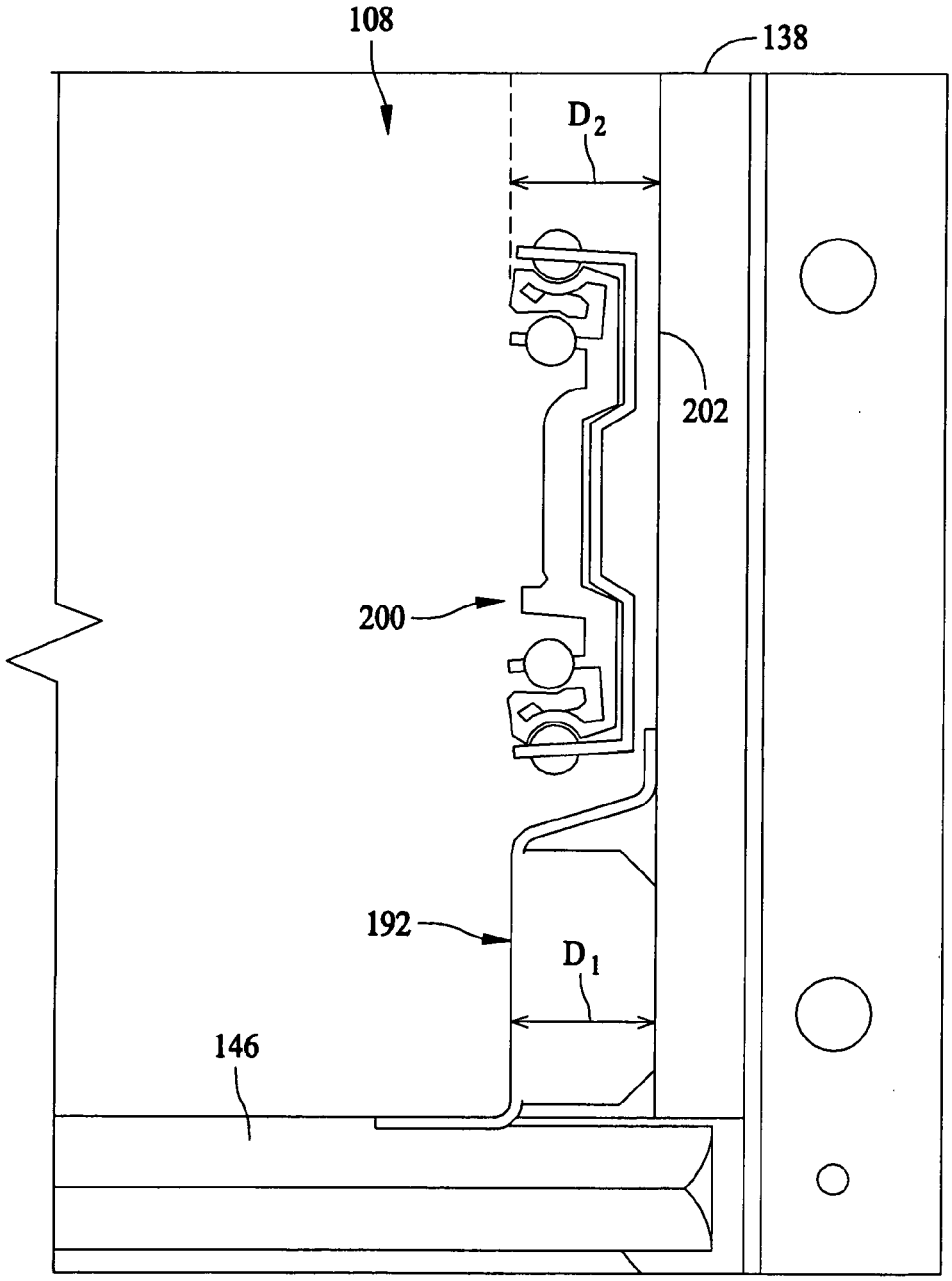
FIG. 6 is a front fragmentary view of an exemplary lower cavity configured to house a storage drawer.

In an alternative embodiment, cooking appliance 100 may include only an upper oven 110 in which case, lower cavity 108 would include only a warming drawer (not shown) or a storage drawer (not shown) rather than lower oven 114. FIG. 6 illustrates a front fragmentary view of a lower portion of cabinet 102 configured to hold a warming drawer or a storage drawer. The storage or warming drawer is supported by drawer slide mechanism 200 that is mounted on an interior surface 202 of side rail 138. As illustrated in FIG. 6, channel 192 is positioned below drawer slide 200. Channel 192 has an interior depth $D_1$ that is substantially the same as an interior depth $D_2$ of slide mechanism 200. In this manner, channel 192 does not diminish the usable volume of the drawer. Similarly, when cooking appliance 100 includes lower oven 114, channel 192 does not substantially diminish the usable volume of oven 114.

The embodiments thus described provide a ventilating apparatus for a cooking appliance that employs convective air flow to cool the appliance cabinet. The apparatus includes an air channel that directs convective air flow between the oven and the side panel of the appliance cabinet to maintain the cabinet temperatures within acceptable levels. The apparatus employs openings in structural side rails to direct cooling air into a space between the oven and the side panels with having to free float the side panels. Slots are provided in the cabinet bottom panel to admit air. The slots are formed by cutouts in side edges of the bottom panel which positions the slots proximate the side rails so that bending or turning of the air flow is minimized. The air channel has a depth that is approximately the same as a drawer slide mechanism so that usable storage drawer or warming drawer volume and oven volume is not compromised. The ventilating apparatus may be used with single or dual oven ranges employing gas, electric, or combination gas and electric ranges.

While the invention has been described in terms of various specific embodiments, those skilled in the art will recognize that the invention can be practiced with modification within the spirit and scope of the claims.

What is claimed is:

1. A cooling apparatus for cooling a cabinet of a cooking appliance including an oven within exterior side panels, said cooling apparatus comprising:

a side rail defining at least one opening;

a bottom panel coupled to said side rail, said bottom panel defining a slot extending through said bottom panel; and a cover extending between said bottom panel and said side rail and forming a channel therebetween, said slot opening into said channel, and said cover configured to direct cooling air via natural convection through said channel and the at least one opening into a space between the oven and a corresponding exterior side panel.

2. A cooling apparatus according to claim 1 wherein said cover is coupled to at least one of said bottom panel and said side rail.

3. A cooling apparatus according to claim 1 wherein said bottom panel includes a side edge and said slot comprises a cutout in said side edge.

4. A cooling apparatus according to claim 1 wherein said cover is configured to direct cooling air via natural convection through openings in said side rail and into a gap between said side rail and said side panel.

5. A cooling apparatus according to claim 1 wherein said channel includes substantially closed ends.

6. A cooling apparatus according to claim 1 wherein the cooking appliance includes a lower drawer supported by a drawer slide and said channel is positioned below the drawer slide.

7. A cooling apparatus according to claim 6 wherein said channel has a depth that is approximately the same as a depth of the drawer slide.

8. A cooking appliance comprising:

a cabinet including opposed side panels, a bottom panel, positioned between said side panels, and a side rail defining at least one opening, said side rail coupled to each said side panel, said cabinet configured to be supported on a supporting surface such that an air gap is formed between said bottom panel and the supporting surface, said bottom panel defining at least one slot extending through said bottom panel for admitting cooling air;

at least one oven positioned within said cabinet and defining a space between said oven and said side panels; and a cover extending between said bottom panel and said side rail and forming a channel therebetween, and said cover configured to direct cooling air via natural convection through said channel and said at least one opening and through said at least one slot into a space between the oven and a corresponding side panel.

9. A cooking appliance in accordance with claim 8 wherein said cover is coupled to at least one of said bottom panel and said side rail.

10. A cooking appliance in accordance with claim 8 wherein said bottom panel includes a side edge and said slot comprises a cutout in said side edge.

11. A cooking appliance in accordance with claim 8 wherein said cover is configured to direct cooling air via natural convection through openings in said side rail and into a gap between said side rail and said side panel.

12. A cooking appliance in accordance with claim 8 wherein the cooking appliance comprises a range including a cooktop.

13. A cooking appliance in accordance with claim 8 wherein said at least one oven includes a first oven and a second oven.

14. A cooking appliance in accordance with claim 8 further comprising a lower drawer supported by a drawer slide, said channel positioned below said drawer slide.

15. A cooking appliance in accordance with claim 14 wherein said channel has a depth that is approximately the same as a depth of said drawer slide.

16. A cooking appliance in accordance with claim 1, further comprising a backsplash including an exhaust vent to exhaust cooling air through a front of said backsplash.

17. A cooking appliance in accordance with claim 1, wherein the cooking appliance comprises a central axis equidistant between the exterior side panels, and wherein the slot is positioned at a first distance from the central axis and the at least one opening is positioned at a second distance from the central axis greater than the first distance.

* * * * *